United States Patent [19]

Pardoe

[11] 4,378,686

[45] * Apr. 5, 1983

[54] FORMING OF MATERIALS BY EXTRUSION

[75] Inventor: John A. Pardoe, Lytham St. Annes, England

[73] Assignee: United Kingdom Atomic Energy Authority, London, England

[ * ] Notice: The portion of the term of this patent subsequent to Sep. 5, 1997, has been disclaimed.

[21] Appl. No.: 883,662

[22] Filed: Mar. 6, 1978

[30] Foreign Application Priority Data

Mar. 16, 1977 [GB] United Kingdom ..... 11047/77

[51] Int. Cl.[3] ..... B21C 23/02; B21C 29/00

[52] U.S. Cl. ..... 72/262; 72/201; 72/342; 29/125

[58] Field of Search ..... 72/253 R, 262, 270, 72/342, 201, 236; 29/125, 124, 121.6; 425/224, 79

[56] References Cited

U.S. PATENT DOCUMENTS

| | | | |
|---|---|---|---|
| 24,453 | 6/1859 | Gage | 29/125 X |
| 177,424 | 5/1876 | Richards | 29/125 |
| 375,352 | 12/1887 | Handloser | 29/125 |
| 1,428,142 | 9/1922 | Canda | 29/125 |
| 3,289,631 | 12/1966 | Vachon et al. | 29/125 |
| 3,604,237 | 9/1971 | Kawanami | 72/201 |
| 3,787,942 | 1/1974 | Bindernagel et al. | 29/125 |
| 3,843,299 | 10/1974 | Bochanov et al. | 29/125 |
| 3,911,705 | 10/1975 | Voorhes | 72/270 |
| 3,934,446 | 1/1976 | Avitzur | 72/262 |
| 4,055,979 | 11/1977 | Hunter et al. | 29/125 X |

FOREIGN PATENT DOCUMENTS

| | | | |
|---|---|---|---|
| 1434201 | 5/1976 | United Kingdom | 72/262 |

*Primary Examiner*—Lowell A. Larson
*Attorney, Agent, or Firm*—William R. Hinds

[57] ABSTRACT

A construction of wheel suitable for apparatus for the continuous forming of materials by extrusion and which has an endless groove in its periphery, comprises forming the wheel in two abutting parts joined in a radial plane within the groove base width, the two parts being held in abutting relationship during use of the wheel in performing extrusion. The joining plane need not extend all the way to a driving shaft to which the wheel is secured for rotation, so providing a separation zone which can be used for cooling the wheel material.

9 Claims, 3 Drawing Figures

FORMING OF MATERIALS BY EXTRUSION

BACKGROUND OF THE INVENTION

This invention relates to the forming of materials by extrusion.

Our British Patent Specification No. 1,370,894 discloses and claims a process of and apparatus for the forming of materials by extrusion which can be performed continuously provided the feed material is fed in continuously. The said process in broad terms comprises the steps of feeding material into one end of a passageway formed between first and second members with the second member having a greater surface area for engaging the material to be extruded than the first member, said passageway having a blocked end remote from said one end and having at least one die orifice associated with said blocked end, and moving the passageway-defining surface of the second member relative to the passageway-defining surface of the first member in a direction towards the or each die orifice from said one end to said blocked end such that the frictional drag of the passageway-defining surface of the second member draws the material substantially in its entirety along the passageway and through the or each die orifice.

The apparatus referred to in the said British Patent Specification No. 1,370,894 in broad terms comprises movable and fixed members defining an elongate passageway therebetween, an abutment member arranged to project into and block the passageway, means defining at least one die orifice leading from the passageway and associated with the abutment member, means for continuously feeding material to be extruded into the passageway at a position spaced from the abutment member, the amount of the surface area of the passageway defined by the movable member being greater than the amount of the surface area of the passageway defined by the fixed member, whereby upon movement of the passageway-defining surface of the movable member relative to the passageway-defining surface of the fixed member, the material fed into the passageway is moved by frictional drag with the surface of the passageway in the movable member towards the abutment member and is thereby extruded substantially in its entirety through the or each die orifice.

A particular form of the said apparatus, disclosed in the said British Patent Specification No. 1,370,894, comprises a rotatable wheel member having an endless groove therein and constituting the movable member, a shoe member covering part of the length of the groove, forming a passageway therewith, and constituting the fixed member, an abutment member associated with the shoe member and projecting into the groove and blocking one end of the passageway, and at least one die orifice associated with the abutment member or shoe member. This apparatus is capable of performing continuous extrusion through the die orifice of material fed to the said passageway, provided the feed material is supplied continuously.

Described in our British Patent Specification No. 1,434,201 which is a Patent of Addition to our said British Pat. No. 1,370,894, are improvements in the apparatus specified in the preceding paragraph. They include the improvement of the shoe member having a portion projecting into and extending over a length of the passageway in front of the abutment member and of a width substantially equal to that of the passageway. Another improvement is that the wheel member with groove comprises three abutting discs, the centre disc having a diameter less than the diameter of the abutting outer discs whereby to form the groove, together with means to maintain the discs in abutting relationship. Such means may be opposed inwardly-acting compressive forces exerted on the outer faces of the outer discs.

The three part wheel is a way of avoiding stress concentration at the abrupt changes of direction manifest by the groove corner that would exist in a groove machined into a single part wheel.

During extrusion the wheel is subject to cyclic loading which is partly thermal and partly mechanical. The thermal loading derives from the temperature rise resulting from sliding friction between the feed material, the shoe member and the wheel, and from the deformation energy developed in the process. The mechanical loading derives from the pressure generated in the zones where upsetting and extrusion occur. Both of these loadings are cyclic because they occur being rotation as each part of the working surface of the wheel passes in and out of the extrusion zone. The combined cyclic loading eventually can give rise to the production of micro fatigue cracks in the groove surfaces, such cracks tending to propagate as feed material is forced into them by the said pressure until failure occurs.

In the three-part wheel there is difficulty in extracting heat from the centre part which forms the root of the groove and this component is more susceptible to failure from thermal fatigue than the side parts. The present invention seeks to provide a wheel construction which reduces or overcomes this disadvantage.

SUMMARY OF THE INVENTION

According to the present invention, we provide, in or for apparatus for the continuous forming of materials by extrusion, a rotatable wheel member with an endless groove in the wheel periphery, such wheel member being formed in two abutting parts joined in a radial plane within the groove base width, and means being provided for holding the two parts in abutting position during the operation of the wheel member to perform extrusion.

The said means may consist of a hydraulic nut arranged for generating opposed forces serving to hold said parts in said abutting position.

The joining plane may be midway across the groove base width, or may be non-symmetrically disposed relative to the groove base width, or may be in the same plane as one of the groove side walls.

The joining plane preferably extends radially only part way to a driving shaft to which the wheel member is keyed or otherwise secured for rotation therewith, there being an annular portion providing an annular separation zone extending radially from the driving shaft periphery part way towards the groove of the wheel member. Means may be provided for circulating coolant into and out of said separation zone, or alternatively said separation zone can be filled with a material of higher heat conductivity than that of the material constituting the said parts of the wheel member.

Where the joining plane is not in the same plane as one of the groove side walls, the groove corners are preferably radiused to reduce stress concentrations.

DESCRIPTION OF THE DRAWINGS

Constructional embodiments of the invention will now be described by way of example with reference to the accompanying drawings, wherein.

DESCRIPTION OF THE PREFERRED EMBODIMENTS

Figure 1:
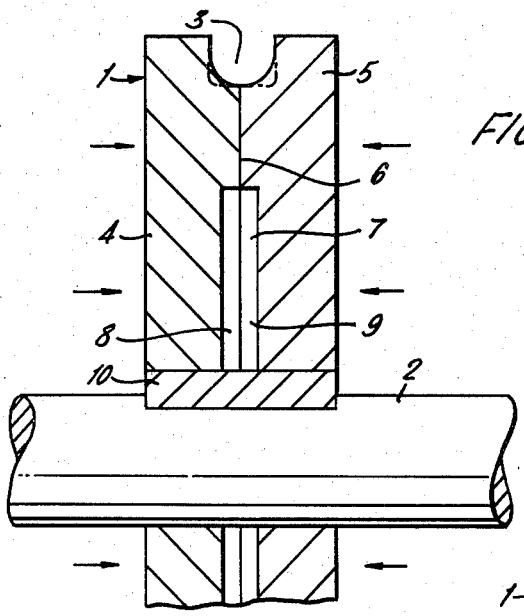
FIG. 1 is a fragmentary side view in medial section and illustrates a first embodiment and, FIGS. 2 and 3 are similar views to FIG. 1 and show second and third embodiments respectively, like numerals indicating like parts.

Referring firstly to FIG. 1 of the drawings, we provide a wheel 1 for apparatus for performing a process of continuous forming of materials by extrusion as described in our British Patent Specification No. 1,370,894. The wheel 1 is rotated by a driven shaft 2 and has an endless groove 3 in its periphery, the groove 3, shaft 2 and wheel 1 being functionally identical to the groove 3, shaft 2 and wheel 1 shown in FIGS. 1–4 of our said British Patent Specification No. 1,370,894. However, instead of the wheel 1 being in one piece with the groove 3 machined or otherwise formed in the periphery of the single piece, it is in the present embodiment and according to the present invention formed in two parts designated 4 and 5 respectively. The parts are mirror images of one another and abut along a joining surface 6 which is symmetrical with respect to the groove 3. The surface 6 extends only part way to the shaft 2, there being a separation zone 7 formed by recessed portions 8, 9 of the parts 4, 5 respectively. A key 10 secures the parts 4, 5 to the shaft 2 for rotation therewith. There may be more than one key 10, others being equi-angularly spaced around the shaft 2, if required for effective load transference. Equal and opposite forces (schematically indicated by the arrows) are applied to the outside surfaces of parts 4, 5 to keep the parts abutting along the surface 6. Such equal forces may be applied by a hydraulic nut applied to the outer surface of one part, with an axially secured reaction disc abutting the outer surface of the other part (neither being shown). The groove 3 instead of being rectangular in section as shown in our said British Patent Specification No. 1,370,894, is preferably made with radiused corners as shown in FIG. 1, which helps to avoid stress concentrations at positions where shear fracture may occur on outward pressure from material within the groove 3.

As has been stated, one of the mechanisms which can lead to wheel failure is pressure-temperature cycling. Work done on material in groove 3 produces heat and as this is cyclic, there is a temperature cycling in the wheel material. The effects of this can be somewhat offset by efficient cooling of this material. This can be arranged by providing for coolant liquid to circulate in separation zone 7 from axial and radial bores in shaft 2 (not shown). Alternatively a heat sink can be introduced into this zone 7 such as a material of higher conductivity than that of the wheel material. The wheel material will generally be an alloy steel such as a hot working steel of the 5% chrome type. Examples of suitable material for use as a heat sink with such wheel material are the metals sodium or copper.

Figure 2:
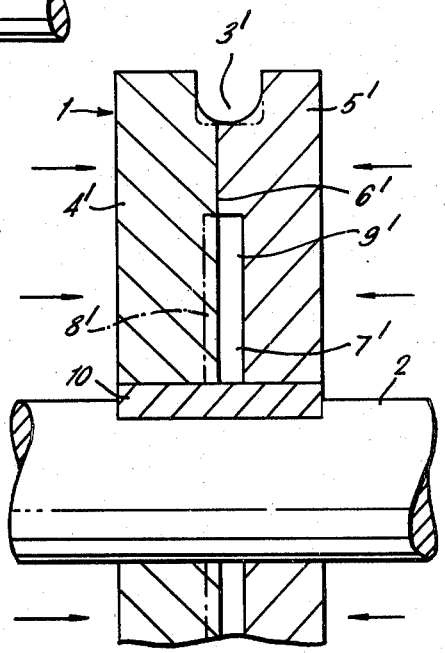

In the construction illustrated in FIG. 2, the construction is similar to that shown in FIG. 1 except that the joining surface 6' is asymmetrical with respect to the groove 3'. Thus the parts 4', 5' are not mirror images. The separation zone 7' can either be formed by a recessed portion 9' on the part 5' with the joining surface 6' extended radially inwardly, as shown, or it can be provided by the recessed portion 9' plus a recessed portion 8' of the part 4' as indicated in dot-and-dash lines. The separation zone 7' can be provided with circulated liquid coolant or with a heat sink, both for example as described with reference to the FIG. 1 embodiment.

Figure 3:
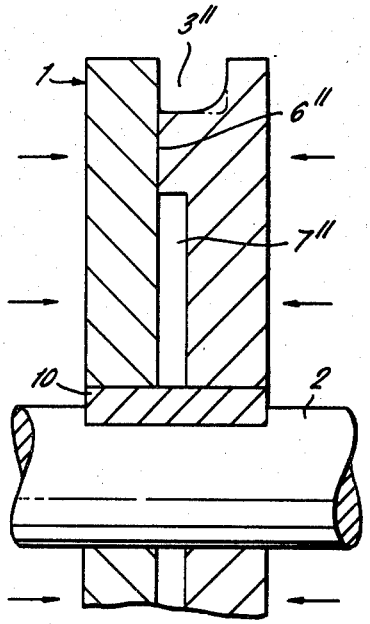

FIG. 3 illustrates the case where the joining surface 6'' is not only extended radially inwardly as in FIG. 2, but is also extended radially outwardly and forms one wall of the groove 3''. In this case, the groove 3'' has one radiused base-wall corner and one unradiused corner, as illustrated. The separation zone 7'' again can be provided with means for removing heat from the wheel parts, as herein described.

The invention also provides for the wheel to be repaired instead of being replaced should fatigue micro cracks occur in the walls of the groove. The groove profile can be machined to machine out such cracks, and the joining surface can also be machined to compensate for the groove machining. This is obviously more economical than having to provide a completely new wheel.

In all constructions, the groove can alternatively have a flat base with radiused corner(s), as shown in dot-and-dash outline. In the FIG. 3 embodiment, only one corner, the right hand one, would be radiused.

I claim:

1. In apparatus for the continuous forming of materials by extrusion, a wheel member with an endless peripheral groove and comprising an assembly of two parts joined in a radial plane within the groove base width, at least one of the parts having a portion which abuts with the other part along the said joining plane, the amount of abuttment being limited to extending radially only part way to a driving shaft to which the wheel member is secured for rotation therewith, for providing an annular separation zone extending from the driving shaft periphery part way towards the groove of the wheel member, and means for holding the two wheel member parts in abutting position during rotation of the wheel member by the driving shaft for operation to perform extrusion.

2. A wheel member according to claim 1, wherein the joining plane is midway across the groove base width.

3. A wheel member according to claim 1, wherein the joining plane is non-symmetrically disposed relative to the groove base width.

4. A wheel member according to claim 1, wherein the joining plane is in the same plane as one of the groove side walls.

5. A wheel member according to claim 4, wherein only the groove corner opposite the groove side wall containing the said joining plane is radiused to reduce stress concentration during the operation of the wheel member to perform extrusion.

6. A wheel member according to claim 1, including the provision of means for circulating coolant into and out of said separation zone.

7. A wheel member according to claim 1, wherein said separation zone is filled with a material of higher heat conductivity than that of the material constituting the said parts of the wheel member.

8. A wheel member according to claim 1, wherein the groove corners are radiused to reduce stress concentrations during operation of the wheel member to perform extrusion.

9. Apparatus for performing continuous extrusion and including a rotatable wheel member having an endless groove in the wheel periphery, a stationary shoe member covering part of the length of the groove thereby forming a passageway therewith, a stationary abutment member associated with the shoe member and projecting into the groove so as to block one end of the passageway, and at least one die orifice associated with the abutment member or shoe member and in communication with said passageway in the region of the blocked end thereof, wherein the said wheel member is constituted according to claim 1.

* * * * *